United States Patent [19]

Scholl

[11] 4,128,913

[45] Dec. 12, 1978

[54] TRIM GUIDE

[76] Inventor: Albert S. Scholl, 2706 S. Kedvale Ave., Chicago, Ill. 60623

[21] Appl. No.: 848,270

[22] Filed: Nov. 3, 1977

[51] Int. Cl.[2] ..... A46B 17/00; B44D 3/22

[52] U.S. Cl. ..... 15/246; 15/248 R

[58] Field of Search ..... 15/166, 246, 248 R, 15/437; 33/39 B, 41 F; 401/48, 193

[56] References Cited

U.S. PATENT DOCUMENTS

| | | | |
|---|---|---|---|
| 1,882,535 | 10/1932 | Weber | 15/166 |
| 1,927,962 | 9/1933 | Tamplin | 15/166 |
| 2,175,587 | 10/1939 | Archer | 15/246 |
| 2,558,191 | 6/1951 | Nightingale | 15/166 |
| 2,712,667 | 7/1955 | Stearn et al. | 15/246 |

FOREIGN PATENT DOCUMENTS

| | | | |
|---|---|---|---|
| 1370479 | 7/1964 | France | 15/248 R |
| 134442 | 2/1952 | Sweden | 15/248 R |

*Primary Examiner*—Daniel Blum

*Attorney, Agent, or Firm*—McCaleb, Lucas & Brugman

[57] ABSTRACT

A trim guide for a painter's brush having optional right and left-hand guide brackets mounted in selected biangular relation to the lengthwise brush axis for respectively supporting individual guide shoes in position to engage walls or other guide surfaces in a manner suitable to maintain the axis of the brush and bristles in predisposed angular relation and contact with a surface to be painted. The guide also performs to adjustably regulate the touch and area of bristle contact while operably guiding the brush for movement along a desired path.

9 Claims, 11 Drawing Figures

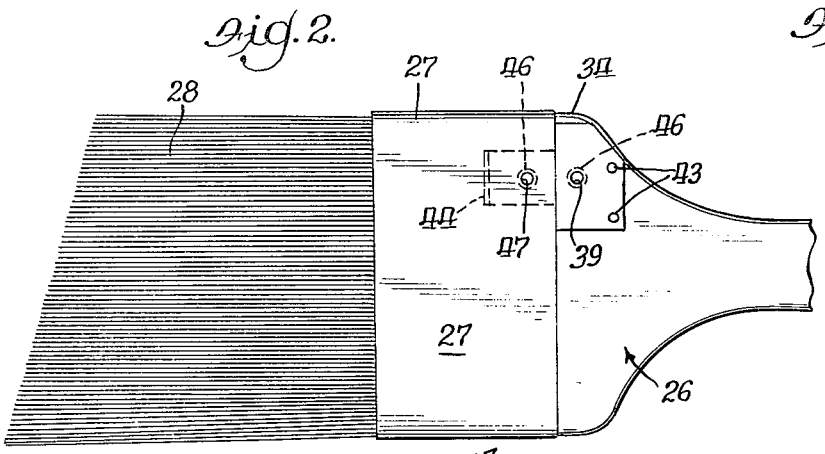
Fig. 2.
28
27
Д6
3Д
Д6
Д3
ДД
Д7
39
27
26
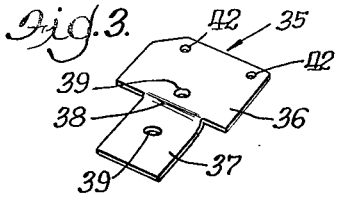
Fig. 3.
Д2
35
Д2
39
38
36
39
37
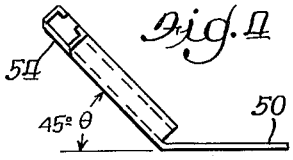
Fig. Д
5Д
45° θ
50
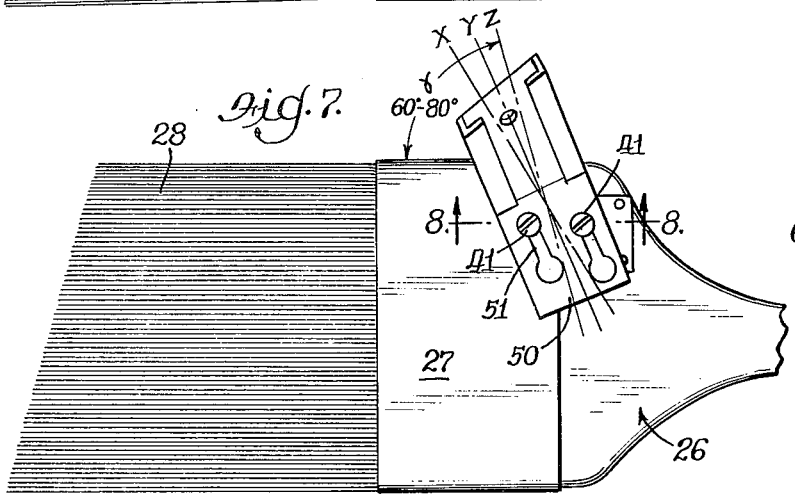
Fig. 7.
X Y Z
γ
60°-80°
28
Д1
8.
8.
Д1
51
50
27
26
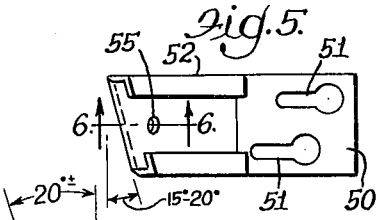
Fig. 5.
55
52
51
6.
6.
20°±
15°-20°
51
50
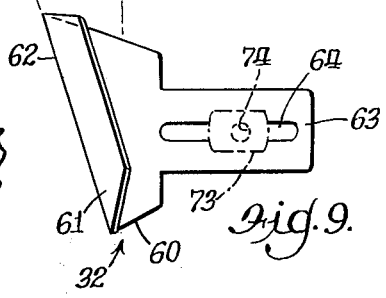
62
7Д
6Д
63
73
61
60
32
Fig. 9.
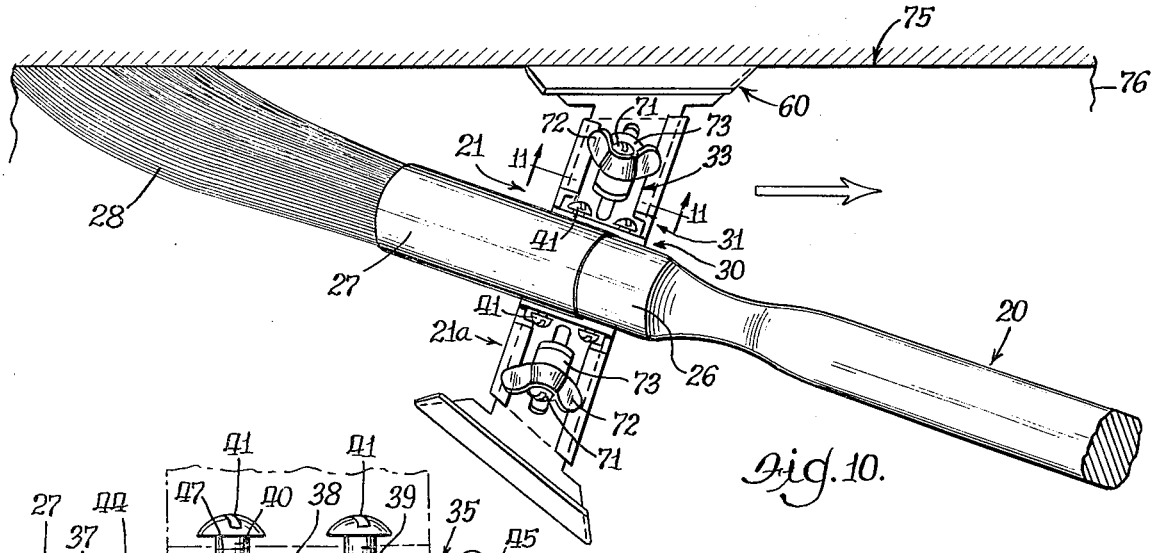
75
76
60
72
71
73
21
11
33
11
28
Д1
31
30
27
Д1
21a
73
26
20
72
71
Fig. 10.
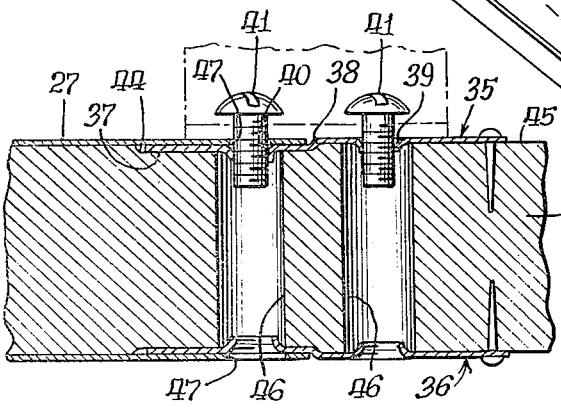
Д1
Д1
27
ДД
Д7
Д0
38
39
35
37
Д5
26
Д7
Д6
Д6
36
Fig. 8.
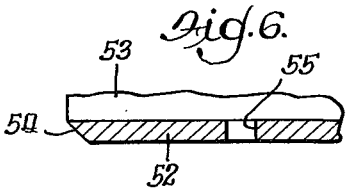
Fig. 6.
53
55
5Д
52

TRIM GUIDE

BACKGROUND OF THE INVENTION

In the past, the striking of trim lines with a paint brush has been largely a matter of the painter's freehand skill and experience, requiring a steady hand and touch; qualities all too often lacking in the novice painter. Thus, there has been a particular need for a simple, reliable and conveniently usable means for assisting the inexperienced painter in moving and guiding a paint brush along a desired path. By the same token, there has been a corresponding need for a simple, work-saving device to assist the professional painter in this painstaking task.

So far as I am aware, all heretofore known guide means for this purpose have been deficient in their ability to provide conveniently usable means for maintaining the brush at a proper contact angle with respect to the painting surface while preserving the painter's touch and feel of the bristle contact with such surface.

SUMMARY OF THE INVENTION

The present invention is directed to improved means for providing an effective solution to the above-noted problems and to the successful fulfillment of the heretofore unsatisfied needs of both professional and amateur painter alike.

In brief, the present invention relates to the paint and decorating art, and more particularly is directed to an improved brush and guide tool combination for assisting the painter in making accurate trim lines. To this end, the current invention comprises anchor means associated with the brush handle for mounting optional left and right-hand support means thereon; the support means being mounted in selected biangular relation to the major axis of the brush and bristles and adapted to carry individual guide means for engaging a cooperating guide surface whereby to regulate the angle, area and pressure of bristle contact with a surface to be painted.

Among the objects of the invention is the provision of improved trimming guide for a painter's brush.

Another important object of this invention is to provide an improved guide means for use with a paint brush which is operably capable of regulating contact area and pressure between the bristles and the surface to be painted.

Another important object of this invention is to provide an improved means for guiding a painter's brush along a designated path, while maintaining a predetermined angle of contact between the brush bristles and the surface to be painted.

A further important object of this invention is to provide improved guide means as set forth in the immediately preceding objective, which preserves the painter's feel or touch of the brush bristles with the surface to be painted.

Having thus described the present invention, the above and further objects, features and advantages thereof will appear from the following detailed description of a preferred embodiment thereof representing the best mode presently contemplated for enabling those skilled in the art to carry out its teachings; such preferred embodiment being illustrated in the accompanying drawings, in which:

FIG. 1, an exploded perspective view of a paint brush and guide means according to this invention;

FIG. 2 is a partial plan view of the paint brush illustrated in FIG. 1 and anchor means associated therewith;

FIG. 3 is a perspective view of the anchor means seen in FIG. 2;

FIG. 4 is a side elevational view of a support means mountable on the anchor means of FIG. 3;

FIG. 5 is a top plan view of the support means shown in FIG. 4;

FIG. 6 is an enlarged cross-sectional view taken substantially along vantage line 6—6 of FIG. 5 and looking in the direction of the arrows thereon;

FIG. 7 is a partial plan view, corresponding to FIG. 2, and illustrating the assembled anchor means and support means of FIGS. 3–5 mounted thereon;

FIG. 8 is an enlarged cross-sectional view taken substantially along line 8—8 of FIG. 7 and looking in the direction of the arrows thereon;

FIG. 9 is a top plan view of a right-hand guide shoe mountable on the assembly of FIG. 7;

Figure 11:
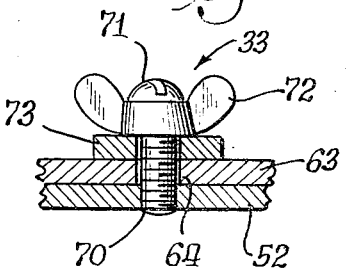

FIG. 10 is a top plan view of a paint brush equipped with left and right-hand guide means according to this invention and illustrating the mode of performing trimming operations therewith; and FIG. 11 is an enlarged cross-sectional view taken substantially along vantage line 11—11 of FIG. 10 and looking in the direction of the arrows thereon to illustrate particulars of the assembled parts shown in that FIGURE.

DESCRIPTION OF THE PREFERRED EMBODIMENT

Figure 1:
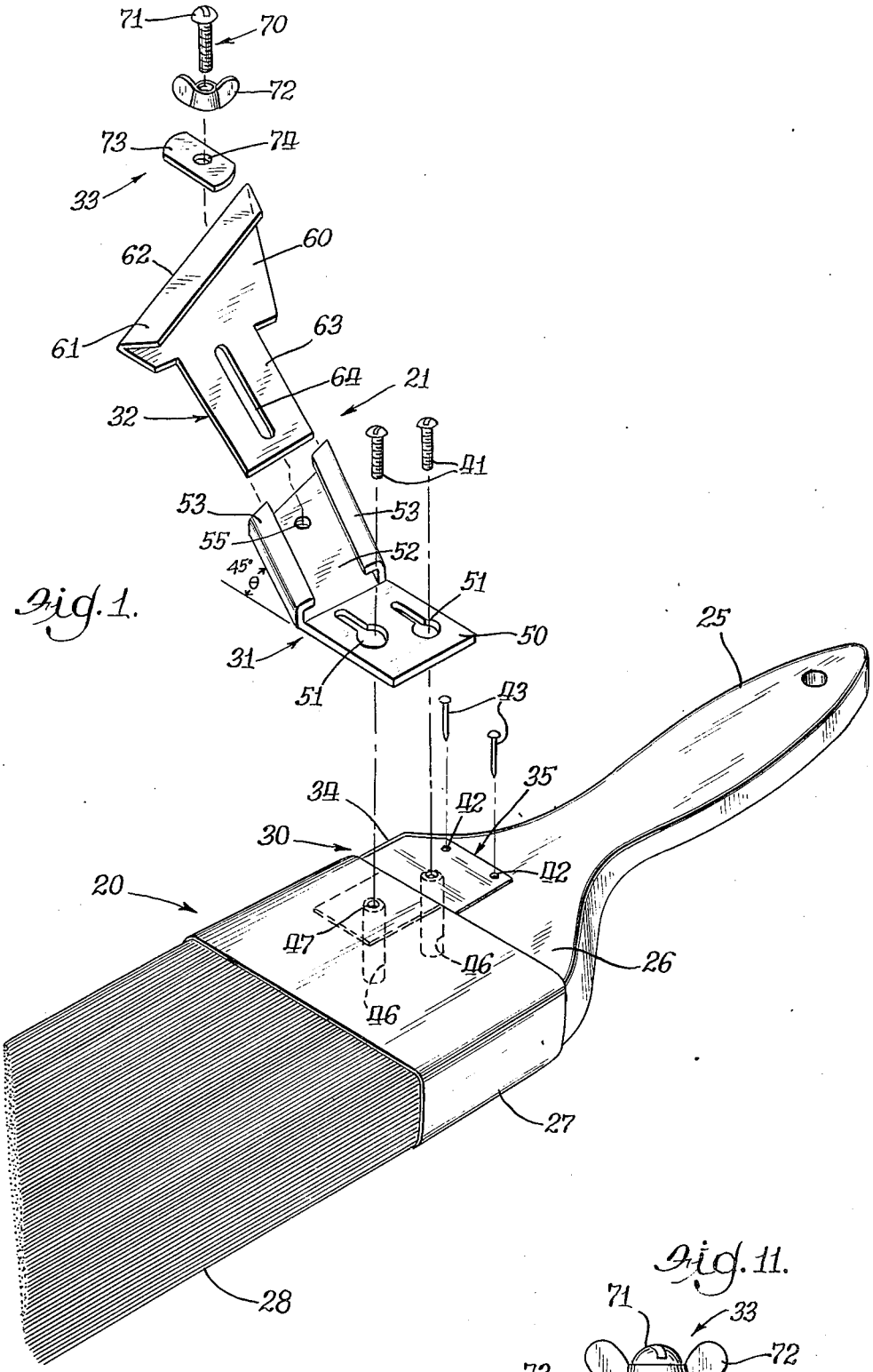

Turning now to the features of the preferred embodiment illustrated in the accompanying drawings to demonstrate the present invention, initial reference is made to FIG. 1 showing a typical paint brush 20, of the type preferred for trimming work, in association with a single guide means or assembly 21 according to this invention.

As shown in FIG. 1, brush 20 comprises a wooden or plastic handle 25 of convention formation having an enlarged base portion 26 surrounded by a metal band or ferrule 27 for holding a body of brush bristles 28 to the handle. In the particular illustrated instance the bristles 28 are in a tapered formation to provide a familiar tapered trim brush. Although it is fully contemplated that the guide means of the present invention may be formulated as an attachment for existent brushes, requiring a minor conversion of the latter, as will be explained hereinafter, adaptation of the brush for the acceptance of the guide means of this invention also may take place in the original manufacture of the brush. In either event, whether a conventional brush is converted to receive and mount the guide means of this invention or a brush is originally manufactured with the guide means thereon, the results are the same.

Guide assembly 21 shown in FIG. 1 sets forth the features of a right-hand assembly which will be described in detail hereinafter; it being understood that a left-hand assembly comprises the same fundamental elements as the illustrated right-hand assembly, but of reflective reverse formation thereto. Specifically, assembly 21 comprises an anchor means 30 mounted on the brush handle, support means 31 attachable to the anchor means, and a guide means 32 adjustably associated with the support means and coupled thereto by connector means 33. The specifics of each of the aforenoted means will now be set forth in detail:

Anchor means 30 as best shown in FIGS. 1, 2 and 3 of the drawings is adapted to be mounted on the base portion 26 of the brush preferably adjacent to the operationally downwardly disposed margin or edge 34 thereof as shown. As will be understood from FIG. 3, the illustrated anchor means 30 comprises a thin, metal or plastic anchor plate of general T-shape formation, having a planar body portion 36 and a tongue portion 37 extending from one margin thereof. One corner of the body portion 36 is shown rounded or cut away so as to generally parallel the profile of the adjacent handle edge 34. In operation the tongue portion 37 is disposed beneath the ferrule band 27 of the brush. Consequently the plane of the tongue portion is offset from the plane of the body portion 36 by an offset bend portion 38 (see FIG. 8). Each of the planar body and tongue portions of the anchor plate 35 is formulated with a connector opening 39 cut therethrough as by a stamping and punching operation; upsetting the material to provide a slight semi-conical annular rim portion 40 extending outwardly of the planes of such sections. These rim portions act as connector thread means for threaded connection with machine bolt or sheet metal screw mounting means 41 (see FIG. 1) in accordance with familiar sheet metal fastening practices. In addition to the openings 39, 39 above referred to, the main body portion 36 of the plate also includes a pair of spaced openings 42, 42 receptive of fastening nails 43 (see FIG. 1) which serve to secure the anchor plate to the brush handle portion 26 adjacent one edge 34 thereof, as previously noted (see FIGS. 1 and 2).

As best shown in FIG. 8 of the drawings, base portion 26 of the brush handle is cut away under the ferrule 27 to provide a recess 44 for tongue portion 37 so that the latter resides beneath the brush ferrule 27 with its outer surface in contacting adjacency with the undersurface of that band. The offset body portion 36 of the anchor plate, on the other hand, resides over the outer surface 45 of the handle base with its outer face coplanar with the outer face of the ferrule. If one is adapting a conventional brush to the guide means of this invention, it is necessary for this purpose to remove the metal band 27 and undercut the recess 44 for the anchor plate. In the original manufacture of the brush this operation may be carried out when making the handle and prior to the mounting of the ferrule band thereabout.

Additional modification of the brush is required to accommodate the anchor plate and guide means of this invention, namely, the provision of a pair of parallel spaced transverse openings 46, 46, extending through the base of the brush handle and openings 47 through the ferrule 27 as needed, to register with the threaded openings 39. The diameter of openings 46 is larger than openings 39 to provide clearance for the screws 41. This arrangement permits the threaded mounting of the machine screws or sheet metal fasteners through openings 39 without interference with the underlying brush handle.

It will be recognized that the anchor means 30 above described includes the mounting plate 35, the anchor bolts 41, and the fastener means or nails 43 used to secure the T-shaped mounting plate in position on the opposite faces of the brush handle. It is to be noted that faces of the brush handle are each provided with an anchor plate for left and right-hand installations in accordance with the choice of the user, (see FIG. 8). Inasmuch as the two anchor means are alike, but of reverse formation, the description of the right-hand anchor means as set out in the drawings will suffice for both.

It further is to be understood that while the anchor plate 35 is herein illustrated as a separate individual structure, the same may comprise an integral extension of the ferrule band 27, particularly if provided at original manufacture of the brush, so long as provision is made for the coupling thereto of the mounting bolts or screws 41 as will be understood presently.

Turning now to the features of the support means 31, specific reference is made to FIGS. 1, 4–7 of the drawings illustrative of its structural makeup. As shown best in FIGS. 1 and 5, support means 31 comprises a unitary metal or rigid plastic article having a generally rectangular shaped support platform 50 formed with a pair of laterally spaced offset key hole openings 51, 51 therethrough. Each opening receives one of the mounting screws 41 in assembly. Extending angularly outwardly from one margin of the platform 50 is an integral guide arm 52 having a channel shaped cross-section distinguished by a pair of C-shaped channel guides or rails 53, 53 bordering its opposite lateral margins. The outer end of arm 52 is cut at an angle of substantially 15°–20° to the arm's longitudinal axis and, in the particular illustrated case, the plane of the arm 52 lies at approximately 45° with respect to the plane of the platform 50 for optimum strength and support.

As shown in FIGS. 5 and 6 in particular, the outer or bias cut end edge 54 of arm 52 also is chamfered rearwardly at approximately a 45° angle to provide an alternate guide edge surface, as will appear hereinafter.

In addition to the two laterally spaced channel guide rails 53, 53 the arm 52 also is provided with a threaded opening 55 nears its outer end for threading connection with the connector means 33, as will be described presently.

In operational assembly with the anchor means 30, the enlarged ends of the two keyhole shaped openings 51, 51 are mounted over the heads of the machine bolts 41, 41 which protrude outwardly of openings 39 in the anchor plate; the elongated portions of such keyhole openings receiving the threaded shanks of the anchor bolts as illustrated in FIG. 7. It will be noted that the two keyhole shaped openings 51, 51 are longitudinally offset with respect to one another so that when the anchor bolts 41, 41 are disposed against the narrower ends of the openings 51, as shown in FIG. 7, the longitudinal axis of the support means is disposed along axis Y which lies substantially at 70° with respect to the lengthwise axis of the brush and bristles. Variation in this angular disposition of the support means is available by moving either of the bolts 41 away from the smaller end of its respective keyhole shaped opening 51 to provide the range of angular adjustment schematically indicated by axes X and Z in FIG. 7. This range of adjustment is within approximately between 60° and 80° relative to the longitudinal axis of the brush. It will be understood that the generally angular disposition of the support means is inclined toward the outer end of the brush bristles in an advancing relationship. Adjustment of the angular disposition of the support means regulates the angle of contact between the bristles and the surface to be painted and accordingly disposes the brush handle 25 in selected angles of elevation with respect to the painting surface.

Further, it is to be noted that the mounting bolts 41 may be slidably disposed anywhere along the narrow part of the two keyhole shaped openings to provide limited longitudinal adjustment of the support means with respect to the brush. This effectively retracts and advances the support means relative to the surface to be painted and thereby partially regulates the flexing contact of the bristles with that surface and thus adjusts the touch or feel of the bristles with that surface. It will be understood that once the support arm is positioned as desired, the two fastening bolts 41 are locked in position by threading the same into openings 39 of the anchor plate to anchor the support means in the desired operating position. If both left and right-hand support means are employed, they are usually adjusted to like positions.

Turning now to the guide means 32, used in association with the support means 31, its features will best be recognized from FIGS. 1, 9 and 10 of the drawings. As therein shown, guide means 32 comprises a metal or rigid plastic member having a generally planar body portion 60 of irregular trapezoidal formation, having a guide lip portion 61 folded along its one margin to extend outwardly of and backwardly over the plane of body 60 at substantially a 30°–60° relationship therewith. The fold line 62 between portions 60 and 61 forms an obtuse angle of approximately 110 degrees transversely of the longitudinal axis of the guide means 32 to present a generally V-shaped cross-sectioned guide shoe for engaging appropriate guide surfaces when assembled with the described support means 31. In this respect, guide edge 62 generally parallels edge 54 of the support arm in assembly to provide one guide surface while the outer face of lip portion 61 provides a second guide surface.

Extending from the opposite margin of the body portion 60 from that which is distinguished by the backwardly folded lip portion 61, is a generally rectangular shaped mounting tongue 63, coplanar with body portion 60 and provided with an elongated central slot or opening 64. Slot 64 is disposed along the central axis of the mounting tongue and is operationally aligned with opening 55 in the support arm 52. It will be appreciated that the thickness of the tongue portion 63 is such as to fit within the spacing between the guide channels 53 and the opposing face of the support arm 52 so that the guide means 32 may be slidingly fitted on the support arm. Sliding movement of the guide means within the channel guides 53 accommodates longitudinal adjustment of the guide shoe along the support arm. This serves in addition to the previously described adjustment of the support means relative to the mounting bolts as additional means for adjustably regulating the contact pressure, touch and feel of the brush bristles with the surface to be painted.

In order to lock guide means 32 in selected position on the support means, the threaded connector means 33 is employed to tightly clamp the mounting tongue 63 at selected positions along the angularly disposed support arm 52. As best shown in FIGS. 1 and 11, the illustrated connector means comprises a three piece assembly of a threaded machine bolt 70, having a screw driver slotted head 71, a threaded wing nut 72 mountable on the threaded shank of bolt 70 and an elongated clamp washer 73. A central opening 74 is provided in washer 73 to loosely receive the shank of the machine bolt in assembly. By mounting the assembled bolt, wing nut and washer over the mounting arm 63 of the guide means, so that the threaded shank of the mounting bolt 70 passes through the washer and the slotted opening 64 for threading engagement with opening 55 of the support arm portion 52 (see FIG. 11), a simple, but expedient system is provided for locking the guide means 32 in place. It will be understood that the machine bolt 70 is threaded into the opening 55 of the support arm 52 with the tongue 63 of the guide means disposed between the washer 73 and the adjacent face of the support arm 52. By loosening or tightening the wing nut 72 on the threaded shank of the bolt 70, clamping and unclamping action takes place to secure or release the guide means; movement of the guide means relative to the support arm being limited by the length of the elongated slotted opening 64 in the tongue portion 63. Obviously other known connector means may be substituted for the particular means 33 shown.

USE AND OPERATION

Having described the elemental makeup of the improved trim guide of this invention, a brief description of its operational functioning follows, particular reference being had to FIG. 10 of the drawings.

As shown in that FIGURE, a paint brush 20 is equipped with two guide means or assemblies, a right-hand assembly 21 and its left-hand counterpart **21*a*, according to this invention; each such assembly including the heretofore described elemental means 30–33. Normally the paint brush 20 would be held like a pen or pencil with the forefinger extended along the upper edge of the brush handle base to apply bristle pressure. As seen in FIG. 10, striking a trim line along ceiling 75 may be accomplished by utilizing the right-hand guide assembly 21, which has been adjusted to provide the desired limits for contact angle and pressure between the brush bristles 28 and the surface of side wall 76. As shown, the guide shoe 62 of the right-hand guide means 32 is disposed along the intersection between the ceiling 75 and side wall 76, disposing the brush axis at the desirable operating angles relative to the planes of both walls and permitting the brush bristles to engage wall 76 at a desired spread, pressure and contact angle. So long as the guide edge 62 is maintained in contact with the wall 76, the angle of bristle contact and the selected bristle spread and contact pressure will remain fixed in their selected conditions. By keeping the guide edge 62** at the intersection of the ceiling and the wall as illustrated, application of paint by the brush takes place along a given area and line in response to movement of the brush in accordance with the movement arrow indicated in that FIGURE.

In the above-described operation, the left-hand guide assembly **21*a* optionally may be engaged with wall 76 to steady the brush against rotation about the guide edge 62 and thus preserve the selected bristle contact and operating angle for the brush. In addition the left-hand assembly may be used in a manner corresponding to the illustration of FIG. 10, when drawing the brush in the opposite direction from that indicated, as well as in striking appropriate vertical trim lines, for instance, along a vertical door jamb or at the intersection of vertical side walls. In the particular illustrated case of FIG. 10**, the deposit of paint also may take place along both ceiling and the side wall surfaces, if desired, or either of said walls as selected. This may be brought about in accordance with the adjusted positioning of the guide assembly so that deposit of the paint on the selected wall or walls is within the selected painting area as determined by the adjusted area of bristle contact. When painting a floor surface, the elongated arm portion 52 extends outwardly and downwardly from the brush base portion.

It also is to be understood that one or both of the guide assemblies 21, 21*a* may be utilized at the operator's option. Thus, one of the guide means 32 may be removed from its support if only one guide shoe is involved in the operation.

It is of additional importance to recognize that the width of the selected trim border may be adjusted by changing the pressure of contact between the bristles and the painting surface. This is accomplished by selectively moving the guide means 32 relative to its support means 31 to provide more or less bristle contact pressure and attendant spread of the bristle area. Basically the greater the bristle pressure, the wider the area of bristle spread to provide a wider border. Conversely the less bristle pressure, the narrower the trim border and area of bristle contact.

A still further usage modification may be provided by utilizing the chamfered edge 54 of the support means as a guiding edge which is permitted by the removal of the accompanying guide shoe. This condition of operation may be desirable with shorter bristle brushes or in the case where use of the guide shoe 32 would hamper or limit desired bristle contact. Additional variation of this mode of operation may be brought about by removing one of the guide shoes, as for example the left-hand guide shoe, and employing only the right-hand guide shoe. In this condition, rocking or rotating the brush about the guide surface engaging edge 62 permits additional brush pressure and border width in accordance with the operator's feel or touch while preserving the ability to strike a straight trim line.

From the foregoing description, it is believed that those familiar with the art readily will appreciate and understand the improved features and advancements of this invention and will recognize that while the same has been described in association with an illustrative preferred embodiment, the same is susceptible to variation and substitutions of equivalent structures without departing from the ambit of its inventive teachings, which are intended to be unlimited by the foregoing except as may appear in the following appended claims.

The embodiments of the invention in which an exclusive property or privilege is claimed are defined as follows:

1. A trim guide for a paint brush having bristles extending substantially longitudinally of the handle comprising: attachment means on the base portion of the brush; support means having means for interlocking, detachable connection with said attachment means and comprising an elongated portion extending angularly outwardly and downwardly from the base portion when the brush is operationally positioned over a surface to be painted; and detachable guide means at the outer end of said elongated portion including a planar guide surface disposed in preselected angular intersecting bias relation to the lengthwise axis of said elongated portion for operationally engaging an underlying support at positions remotely in advance of the brush bristles as the same are drawn over a surface to be painted; said guide means serving to maintain the brush in predetermined operating position with the bristles thereof in preselected contact with the surface to be painted.

2. The combination of claim 1 wherein said attachment means are located on opposite sides of the brush, and a pair of said support means are connected thereto to diverge angularly outwardly from said opposite sides of the brush; each of said support means having a guide means at the outer end thereof.

3. The combination of claim 1 wherein said guide means is detachably mounted on said support means, and adjustable connector means interjoining said guide and support means.

4. The combination of claim 1 wherein said support means are partially rotatable about said attachment means to permit limited rotational adjustment of said support means whereby to vary the angle of bristle engagement with the surface to be painted.

5. The combination of claim 1 wherein said guide means is detachably mounted on said support means for adjustment longitudinally of said elongated portion whereby to regulate the pressure and area of bristle contact with the surface to be painted.

6. The combination of claim 1 wherein said support means comprises a rigid angulated member detachably joined at one end to said attachment means and including spaced elongated rails on said elongated portion for receiving said guide means.

7. The combination of claim 1 and means operable to adjustably interjoin said guide means and support means for sliding relative movement including connector means for interlocking the same at selected relative positions whereby to dispose said guide surface toward and away from the longitudinal axis of the brush for regulating the pressure of bristle contact with said surface to be painted.

8. The combination of claim 1 wherein said guide means comprises a unitary member having a planar body portion, a coplanar tongue portion extending outwardly of one margin of said body portion, and a lip portion folded outwardly along an opposite margin thereof, the fold line between said lip and body portions being disposed transversely of the longitudinal axis of said unitary member at an intersecting angle therewith determinative of the angle of bristle contact with the surface to be painted.

9. The combination of claim 8 wherein said tongue portion includes an elongated slotted opening receptive of connector means for clamping said guide means to said support means and accommodating adjustment of said guide means relative to said support means whereby to regulate the pressure of bristle contact with said surface to be painted.

* * * * *

UNITED STATES PATENT OFFICE

CERTIFICATE OF CORRECTION

PATENT NO. : 4,128,913

DATED : December 12, 1978

INVENTOR(S) : ALBERT S. SCHOLL

It is certified that error appears in the above-identified patent and that said Letters Patent are hereby corrected as shown below:

Column 7, line 50, before "brush" insert--paint--.

Signed and Sealed this

*Third* Day of *April 1979*

[SEAL]

*Attest:*

RUTH C. MASON
*Attesting Officer*

DONALD W. BANNER
*Commissioner of Patents and Trademarks*